United States Patent [19]

Strongosky et al.

[11] Patent Number: 4,666,048

[45] Date of Patent: May 19, 1987

[54] HOSIERY DISPLAY DEVICE

[75] Inventors: John M. Strongosky, McGraw; David M. Freund, Syracuse, both of N.Y.

[73] Assignee: RPM Industries, Inc., Auburn, N.Y.

[21] Appl. No.: 906,751

[22] Filed: Sep. 12, 1986

Related U.S. Application Data

[63] Continuation-in-part of Ser. No. 689,462, Jan. 7, 1985, Pat. No. 4,624,375.

[51] Int. Cl.[4] ..... A47F 5/12

[52] U.S. Cl. ..... 211/170; 223/75; 403/84

[58] Field of Search ..... 211/170, 60.1, 100, 211/168, 169.1; 248/291; 403/93, 97, 84, 94; 223/60, 75, 112

[56] References Cited

U.S. PATENT DOCUMENTS

| | | | |
|---|---|---|---|
| 258,767 | 5/1882 | Kennard | 211/168 |
| 751,653 | 2/1904 | Katz | 223/75 |
| 1,404,270 | 1/1922 | Carr | 211/170 X |
| 2,617,564 | 11/1952 | Vogt et al. | 223/75 |
| 3,092,362 | 6/1963 | Walsh | 248/291 |
| 3,141,587 | 7/1964 | Albertson et al. | 223/75 |
| 3,570,728 | 3/1971 | De Witt | 211/60.1 X |
| 3,602,466 | 8/1971 | Drowns | 248/514 |
| 4,289,243 | 9/1981 | Arbuzoff | 211/100 X |

*Primary Examiner*—Ramon S. Britts
*Assistant Examiner*—Sarah A. Lechok Eley
*Attorney, Agent, or Firm*—Bruns and Wall

[57] ABSTRACT

A hosiery display device has a plurality of stocking forms mounted on a support housing such that the stocking forms are arrayed in a fan-like configuration. The thigh ends of the stocking forms are scalloped, and these are then held onto a keyed shaft by associated disc-like positioning members which have interengaging peripheral scalloping. The support housing is formed of two identical mating support housing halves, which support the shaft and are held together by the same.

10 Claims, 8 Drawing Figures

HOSIERY DISPLAY DEVICE

This is a continuation in part of our copending U.S. application Ser. No. 689,462, filed Jan. 7, 1985 and now U.S. Pat. No. 4,624,375.

BACKGROUND OF THE INVENTION

This invention relates generally to merchandise display devices, and has particular reference to an adjustable stocking display device having a novel angular adjustment mechanism.

Stocking or hosiery display devices that employ a plurality of stocking forms have been in use for a number of years. These display devices are usually placed on a store counter top and stockings of different colors, sizes or textures are displayed on the forms which are usually fanned out at their upper ends to show off the stockings.

The stocking forms in the prior art display devices are usually supported at their lower ends by a horizontal shaft the ends of which are received in a pair of end support members. The forms are pivotably mounted on the shaft so that a fan-like display arrangement can be achieved, after which a nut or the like is tightened onto the end of the shaft. This forces the end support members closer together and clamps the stocking forms in the angular positions into which they have been moved. The forms are thus frictionally held, rather than mechanically engaged in position. If the display is jarred or bumped, the stocking forms will usually be disturbed from their carefully arranged display positions.

U.S. Pat. Nos. 3,567,084 and 3,570,728 relate to stocking display devices of a different type being constructed and used in a different manner.

The inventors hereof have recently developed the stocking display system of U.S. patent application Ser. No. 689,462 filed Jan. 7, 1985. In that system, a number of stocking forms mounted on a single support or base can be fanned out into a number of different angular positions. There, the support base for the stocking forms comprises a pair of end support plates and a transverse, horizontal threaded shaft affixed by a nut to the support plate. The shaft has a keyway serving as positive locking means for a number of disc-like angular positioning members, each associated with one of the stocking forms. The positioning members and stocking forms have coacting scalloped flanges so that the forms can be held in any of a number of angular positions by the positioning members. The positioning members can be moved axially on the shaft, but are held against rotation.

The basic arrangement of the above stocking display system has proved to be quite effective. However, the support plates do not themselves contribute to the display of the stockings. Also, the assembly of the system is sometimes troublesome for untrained retail store personnel.

OBJECTS AND SUMMARY OF THE INVENTION

It is an object of this invention to provide a housing display device which is simple for an untrained employee to set up, and which presents stocking merchandise or the like in an attractive manner.

It is a more specific object of this invention to provide a hosiery display system in which the stocking forms and a base support housing for the stocking forms present an integrated appearance.

According to an aspect of the invention, the hosiery display device has a plurality of stocking forms mounted on a support in such a manner that the stocking forms radiate out from the support housing in a fan-like arrangement from the axis of a support housing or shell.

The support shaft has a shank portion with a keyway formed on it, and a screw thread at one end. The stocking forms have the general profile of a human extremity (i.e., leg-shaped) with an outer, toe end and an inner, thigh end. The thigh end has a cutout to receive the support shaft. For each stocking form there is a disc like positioning member disposed over the shank portion of the support shaft with a key member formed thereon for preventing rotation of the positioning members on the shaft but permitting sliding of the positioning members axially on the shaft. The peripheries of the positioning members and of the thigh ends of the stocking forms have interengaging scalloping or equivalent structure for locking the stocking forms at the desired angle, relative to the shaft, once the stocking forms have been installed.

A two-part support housing holds the shaft with the stocking forms and associated positioning members. The support housing consists of first and second halves each formed of an outer housing shell half, a base, and a support plate affixed within the shell half, and defining a space between the shell half and the associated support plate. The shell halves and bases are substantially identical, with interengaging tooth and notch structure to facilitate assembly and to render the support housing more stable.

The shaft is affixed on one of the support plates to extend generally transversely, i.e., horizontally, across the housing, and the other support plate has an opening for passage therethrough of the shaft threaded end.

the device is assembled by installing the stocking forms and positioning members alternately over the support shaft, then placing the second housing half against the first with the shaft through the opening in the support plate of the second housing half. A nut secures the shaft to the second housing half. The nut is placed in the space between the shell half and the support plate and is turned down on the threaded shaft end. An access opening for this purpose is provided in the base of the second housing half.

The main thrust of the invention resides in the display device structure, rather than in the fact that the displayed items are stockings. Accordingly, the invention should be construed to apply to display assemblies for gloves, hats, or other apparel or accessory items, provided the display assemblies' structure and function follow the principles and teachings found herein.

The above and many further objects, features, and advantages of this invention will be more fully appreciated from the ensuing detailed description of a preferred embodiment, given as an example and not for purposes of limitation, and which is to be considered in connection with the accompanying drawing.

DETAILED DESCRIPTION OF THE PREFERRED EMBODIMENT

This invention is in many ways much akin to the invention of our earlier patent application, Ser. No. 689,462, now U.S. Pat. No. 4,624,375, the disclosure of which is incorporated herein by reference.

Figure 1:
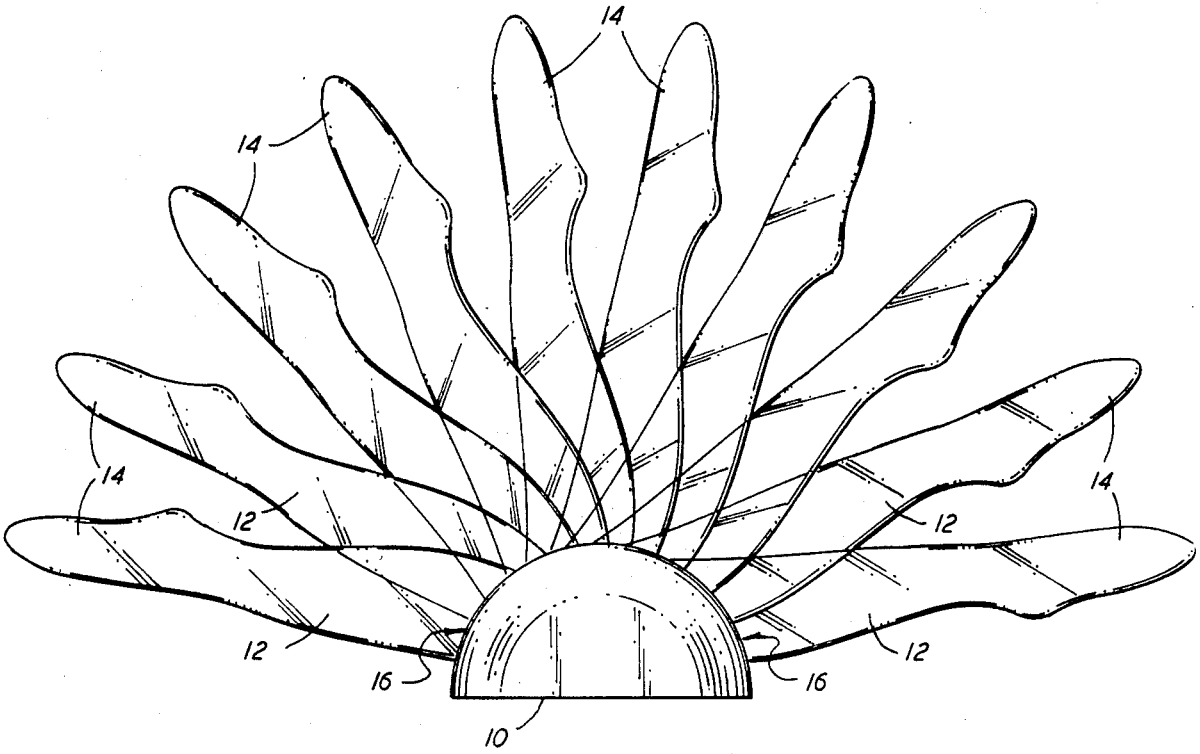
FIG. 1 is a front elevation of a hosiery display device embodying the present invention.

Referring now to the drawing, FIG. 1 shows the hosiery display device according to an embodiment of this invention, basically consisting of a support base 10 and a fan-like array of a toe end 14 disposed radially outward and with a thigh end 16 arranged within the support base 10. In this embodiment there are ten stocking forms 12, although the actual number used is arbitrary.

Figure 2:
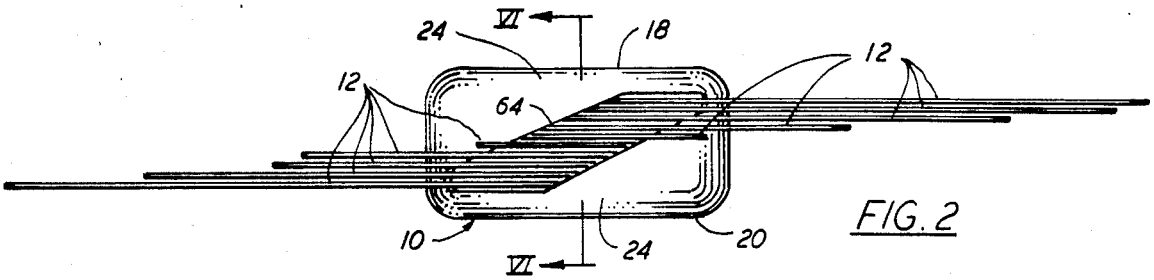
FIG. 2 is a top plan view of the hosiery display device.
Figure 3:
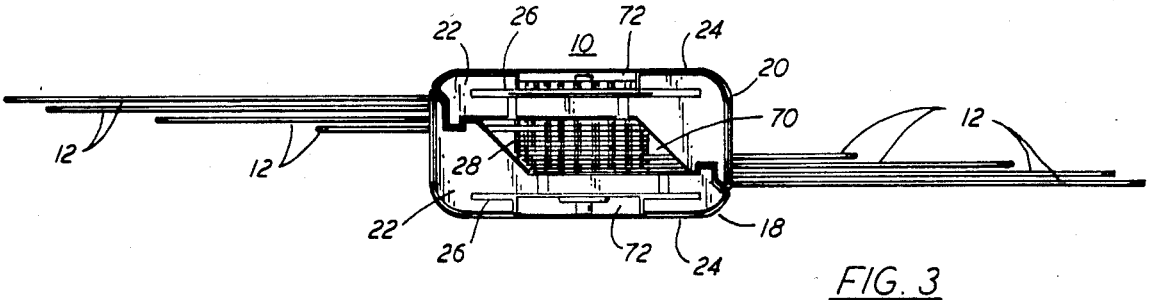
FIG. 3 is a bottom plan view of the hosiery display device.
Figure 4:
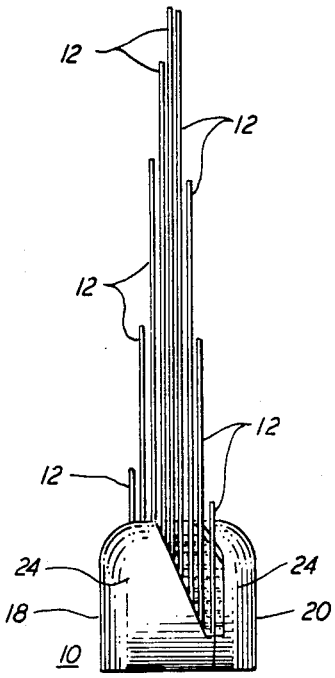
FIG. 4 is a side elevation of the device, the other side elevation being generally the same.

As shown in FIGS. 2, 3, and 4, the support base is formed of first and second support housing halves 18 and 20, with each support half being formed of a base 22 an outer housing shell half 24, and a mounting plate 26. A plurality of scalloped disc-like positioning members 28 are interposed between successive ones of the stocking forms 12 on a shaft 30 that is mounted between the mounting plates 26 of the support housing halves 18 and 20.

Figure 6:
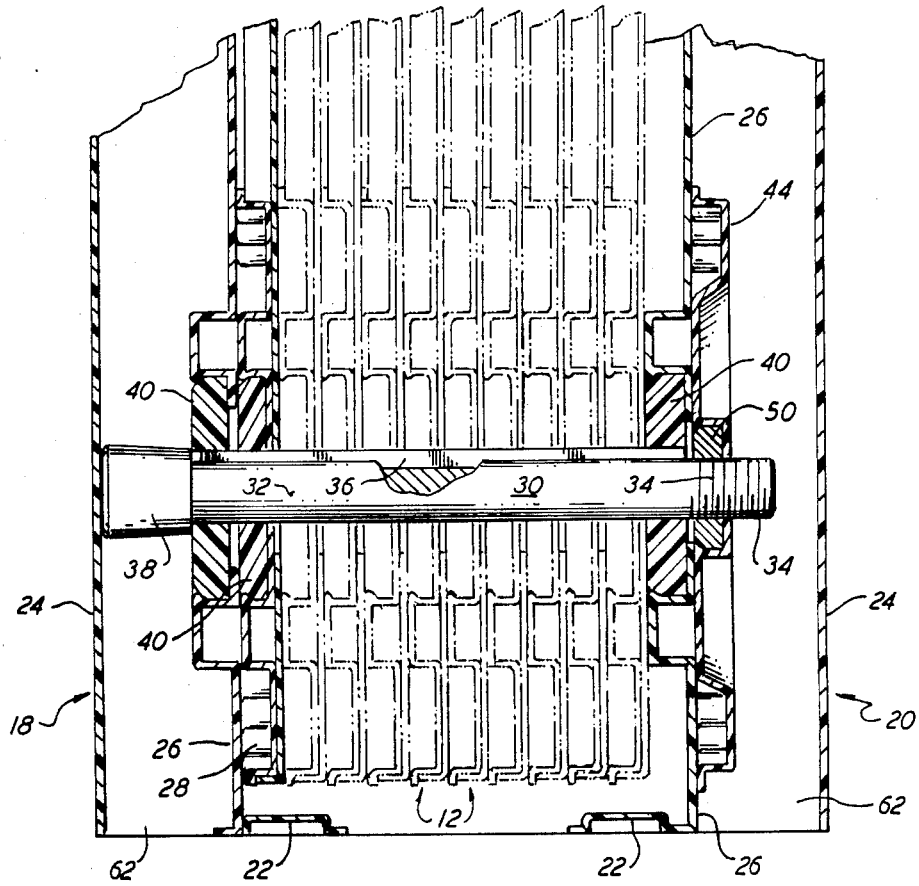
FIG. 6 is a vertical sectional view taken along the line VI—VI of FIG. 2.
Figure 5:
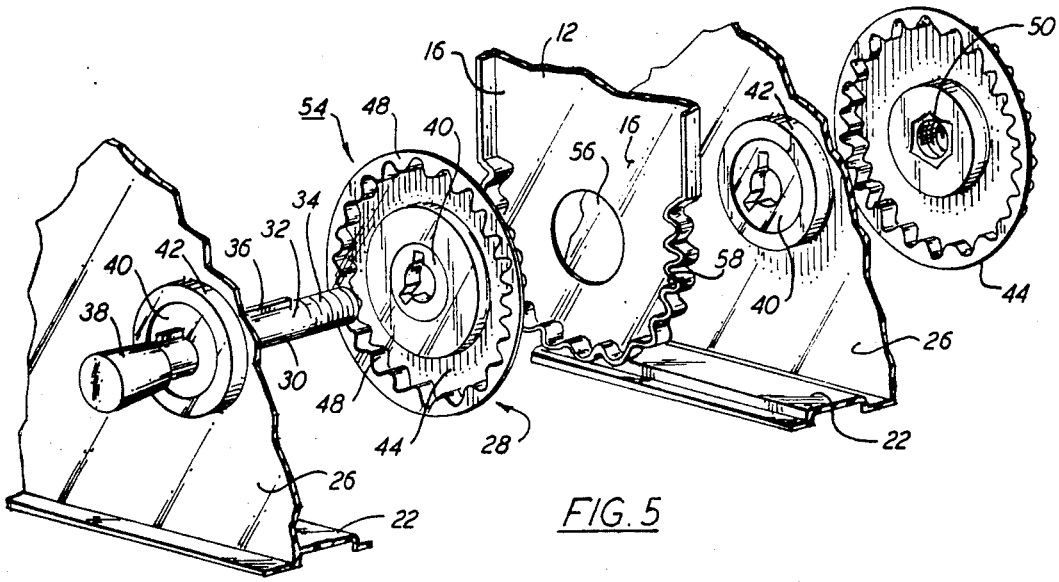
FIG. 5 is an exploded view on an enlarged scale of the positive angular adjustment mechanism of this device.

As further illustrated by FIGS. 5 and 6, the shaft 30 has a shank portion 32 on which the stocking forms 12 and positioning members 28 are disposed, and a threaded end 34. A keyway flange 36 is affixed onto the shank 32 of the shaft 30 and a mounting head 38 is disposed on the end of the shaft 30 opposite the threaded end 34 for affixing the shaft 30 to the mounting plate 26 of the first support half 18.

Apertured key discs 40 are provided, each with a circular aperture and adjacent slots to overfit the shank 32 and keyway flange 36. These key discs 40 are lodged in receptacles 42 in each of the mounting plates 26 and are also centrally affixed in the disc-like positioning members 28. Two keyway slots are formed in the discs 40 so that either an even number or an odd number of mounting plates 28 and stocking forms 12 can be equidistantly displayed in their axial position.

The positioning members 28 are all basically formed of a serrated disc 44 with a receptacle 46 for holding the apertured key disc 40, and with serrations or scalloping 48 at the periphery thereof.

A mounting nut 50 is centrally affixed on another of the discs 44 similar to those used for the positioning members 28. The nut 50 and disc 44 form a finger wheel to facilitate fastening onto the threaded end 34 of the shaft 30.

In this embodiment, numbered indicia 54 appear on the periphery of the scalloped discs 44 in a predetermined relationship relative to the orientation of the keyway of the apertured discs 40. These aid in positioning of the leg forms 12 with respect to the positioning members 28.

As also shown in FIG. 5, the thigh end 16 of the leg forms 12 each have an opening or cutout 56 of significantly greater size than the diameter of the shaft 30, permitting a free fit of the stocking forms 12 on the shaft 30. The leg forms 12 have peripheral serrations or scalloping 58 which interengage with the scalloping 48 of the associated positioning members 28.

Figure 7:
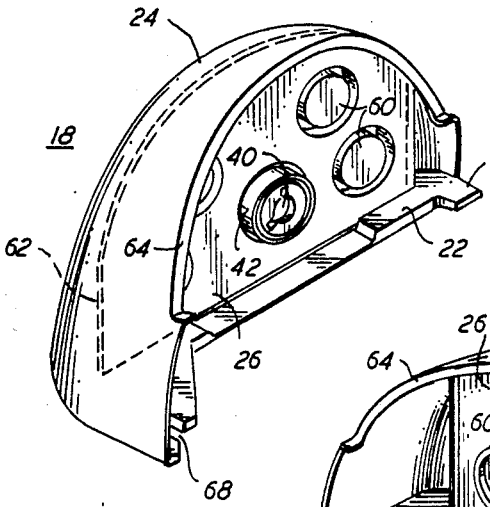
FIGS. 7 and 8 are perspective views of two mating halves of the support housing of the device embodying this invention.
Figure 8:
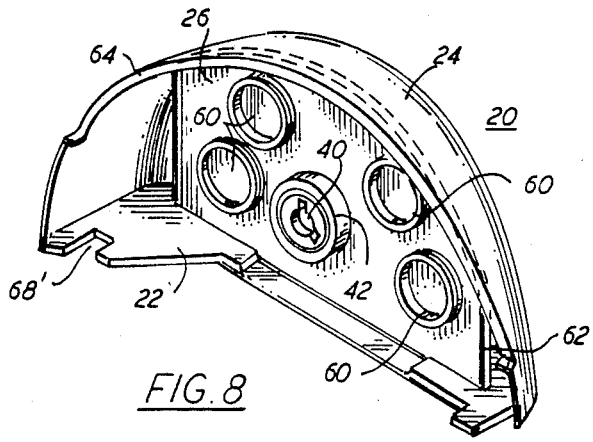

As shown in FIGS. 7 and 8, the first and second support housing halves 18 and 20 are of similar construction, with each having its shell half 24 and base 22 of substantially identical shape and with the mounting plates 26 disposed in a similar fashion in each support housing half 18, 20. The mounting plates 26 each have the receptacle 42 disposed generally centrally thereon, and have additional bosses 60 providing structural support. The mounting plates 26 are spaced somewhat inwards of the respective shell half 24 so as to define a space 62 to the outside of each mounting plate 26. The two halves 18 and 20, when joined together, give the base 10 a generally closed semi-cylindrical shape, with a skewed, i.e., generally diagonal slot 64 therein through which the stocking forms 12 protrude. A tooth 66 is formed to one side of each base 22 and a mating notch 68 is formed to the other side, so that when the halves 18 and 20 are joined, the tooth 66 of each engages with the notch 68 of the other. A large central opening 70, as shown in FIG. 3, remains at the underside of the support base 10 for access to the thigh ends 16 of the stocking forms 12 and to the positioning members 28. Access openings 72 are also provided in each support base housing half 18, 20, for access to the associated space 62 between the support plate 26 and the shell half 24.

As shown in FIG. 6, the head 38 extends across the space 62 from the support plate 26 and provides additional mechanical support for the shell half 24 of the first support housing half 18. The shaft 30 is permanently affixed to the support housing half 18.

The hosiery display device of this embodiment is quite simple to assemble and requires no tools and virtually no skill on the part of the assembler. The assembly procedure is generally as follows: To begin with, one of the stocking forms 12 and one support plate 28 are fit together by interengaging the respective scalloping 48 and 58, and aligning them so that one of the indicia 54 (here #1) on the positioning member 28 is aligned with a mark point on the stocking form 12. Then, this stocking form 12 and positioning member 28 are slid onto the shank 34 and keyway flange 36 of the shaft 30. Next, another stocking form 12 and another positioning member 28 are interengaged in like manner, but with the next indicia (here #2) aligned with the mark point of the stocking member 12. Then this second stocking form 12 and positioning member 28 are slid onto the shaft 30. The third through tenth stocking forms 12 and positioning members 28 are positioned on the shaft 30 in like manner. Finally, the second housing half 20 is mated with the first housing half 18 so that the teeth 66 and notches 68 engage and so that the threaded end 34 of the shaft 30 protrudes through the key disc 40 in the mounting plate 26 of the second support half 20. Then, the finger wheel formed of the nut 50 and disc 44 is inserted through the opening 72 into the space 62 of the housing half 20, and the nut 50 is turned down onto the threaded end 34 of the shaft 30.

The hosiery display device of this embodiment is symmetrical, and has an elegantly simple design so that it can boldly display the latest fashions in leg wear. The structure is quite stable, and will sustain much more than the expected amount of customer abuse. Manufacturing costs are rather low, as only a minimal number of parts of different shapes are required.

While a smooth diagonal slot 64 is shown in this embodiment, the slot 64 could run in another direction, or could be stepped, depending on the preferred orientation of the stocking forms 12. Moreover, while the present embodiment is in the form of a stocking display system with stocking forms in the shape of human legs, this invention could likewise be applied to a glove display device with hand-shaped display members, or a hat display device with members thereon in the form of a human head profile.

While this invention has been described in detail with respect to a single preferred embodiment, it should be recognized that the invention is not limited to that embodiment, and that many modifications and variations thereon could be carried out by those of skill in the art without departing from the scope and spirit of this invention, which is to be ascertained from the appended claims.

We claim:

1. Hosiery display device comprising a support shaft having a shank portion with a keyway formed thereon and a screw thread at one end thereof; a plurality of stocking forms each having a general profile of a human extremity with an outer end and an inner end, the inner end having a cutout therein to receive said support shaft; a plurality of apertured positioning members each being disposed on the shank portion of said support shaft with a key member formed thereon for preventing rotation of the positioning members on the shaft but permitting sliding of the positioning members on said shaft, and each having interengaging structure to engage the inner end of the associated stocking forms in mutually non-rotating engagement; a nut for threadably engaging the threaded end of said shaft; and a two-part support housing for supporting said shaft with said stocking forms and said support members thereon, said housing including first and second halves each formed of an outer housing shell half, a base member, and a support plate affixed within said shell half, defining a space between each shell half and the associated support plate, said support shaft being affixed on one end to one of said support plates, with the other support plate having an opening for passage of the threaded end of the shaft into the associated space thereof to receive the nut thereon.

2. Hosiery display device of claim 1 in which said housing half base members each have a tooth on one side and a notch on the other, the tooth of each housing half engaging the notch of the other housing half.

3. Hosiery display device of claim 2 in which said housing half base members are substantially identical.

4. Hosiery display device of claim 3 in which said bases have cutouts providing access to the space between the shell and the support plate for installation of said nut onto said shaft threaded end.

5. Hosiery display device of claim 1 in which said positioning members each include a disc having a scalloped periphery and a circular receptacle at its center, and a central key disc secured in said receptacle and having a central passageway to fit the shank of said shaft and at least one key cutout to mate with the keyway of said shaft; and in which the thigh end of said stocking forms have mating scalloping for interengaging said scalloped periphery of said positioning members.

6. Hosiery display device of claim 5 wherein said nut is fitted into the receptacle of one of said positioning member discs, the latter serving as a fingerwheel to facilitate turning said nut onto the threaded end of said shaft.

7. Hosiery display device of claim 1 in which said shaft includes a retaining head on the end of the shaft remote from said threaded end, and situated in the space of one of the housing halves and against the associated outer housing shell half to support the same.

8. Hosiery display device of claim 1 in which said housing shell halves when assembled together form a generally closed shell having a slot through which the stocking forms protrude.

9. Hosiery display device of claim 8 in which said slot is skewed with respect to the axis of said shaft to accommodate the stocking forms when fanned out on said shaft.

10. Hosiery display device of claim 1 in which said positioning members each include a disc having a scalloped periphery; the thigh ends of said stocking forms have mating scalloped periphery; and said positioning member discs bear index numbers on their peripheries for matching the scalloping of the stocking forms such that successive ones of said stocking forms on said shaft are arranged at a desired predetermined angle.

* * * * *